United States Patent [19]

Grillo

[11] 4,174,578

[45] Nov. 20, 1979

[54] TRACKED SNOWPLOW

[76] Inventor: Bernardino Grillo, Via Beniamino, 13-, Laigueglia, Italy

[21] Appl. No.: 886,980

[22] Filed: Mar. 15, 1978

[30] Foreign Application Priority Data

May 24, 1977 [IT] Italy ..... 51201 B/77

[51] Int. Cl.[2] ..... E01H 5/00

[52] U.S. Cl. ..... 37/43 R; 198/310; 180/9.42

[58] Field of Search ..... 37/43 R, 43 A–43 K, 37/191 R, 191 A, 192 R, 192 A, 10; 180/9, 9.32, 9.4, 9.42, 9.62; 280/28, 405 R; 198/9, 310

[56] References Cited

U.S. PATENT DOCUMENTS

| | | | |
|---|---|---|---|
| 905,405 | 12/1908 | Britton | 180/9 |
| 3,650,343 | 3/1972 | Helsell | 180/9.4 |
| 3,652,106 | 3/1972 | Waterman | 280/405 R |
| 3,720,299 | 3/1973 | Wegmann et al. | 37/43 R X |
| 4,019,268 | 4/1977 | Waterman | 37/10 |

*Primary Examiner*—E. H. Eickholt

*Attorney, Agent, or Firm*—Beveridge, De Grandi, Kline & Lunsford

[57] ABSTRACT

A tracked snowplow particularly suited for use in very deep snow. A frame is carried on a tracked mover. The frame supports a triangular belt which is made up of a number of chains, stretched about rolls, and a large number of shovels which extend perpendicular to the chains. The shovels engage the links of the tracked mover as the shovels move along their lower run. The upper run of the shovels is angled rearwardly, and so as the snow is carried by the upper run, the weight of the snow helps drive the shovels, and the shovels, engaging the tracked mover, help drive it. From the upper run the snow is deposited into two secondary carrying belts which convey it to the sides of the snowplow for throwing out.

10 Claims, 5 Drawing Figures

Figure 1:
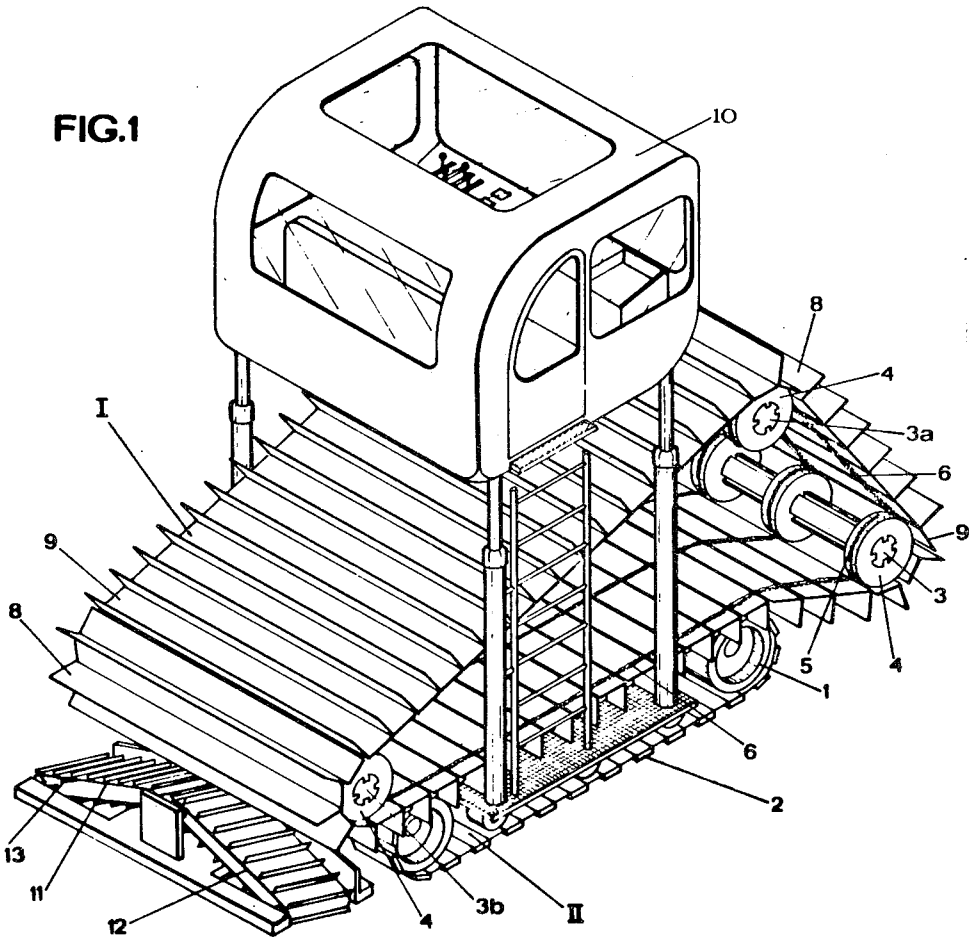

10
I
II
3a
3b
3
8
6
9
1
4
12
15
7
7b
5
14
14a
14b

TRACKED SNOWPLOW

The present invention concerns a tracked snowplough to work mainly against very high snow barriers.

The aim of the present invention is to exploit as much as possible the falling of the dug snow as a source of tractor energy, obtaining a great saving, with the safety of pushing the dug snow to the right or to the left side of the street, "throwing it out" beyond the width of the largest vehicles.

Snowploughs intended are already well known which first break and then dig the snow barrier, by means of push means like plowshares. These machines have the disadvantage that they have to apply a very strong top pressure against the snow barrier, and for this pressure very much energy is needed. Such snowploughs separate the snow to both sides of the street, according to the angle, i.e. according to the shape of the real device for separating the snow. This system has the disadvantage that it does not always give a real guarantee and safety for the clearing of the street, as the real device for separating the snow can not come near or, even more, go over the edge of the street, as it would find many obstacles in this area. Furthermore, these kinds of snowploughs also have the disadvantage that they can not work against very high snow barriers without the danger that the snow which is at the highest part of the barrier might fall onto the machine.

A snowplough is also known which works by the sucking the snow from the barrier, pulverizing the snow and throwing it to the two sides of the street. This snowplough has the disadvantage that its efficiency is too low for use in a very big quantity of snow, because it does not work by a pushing action and does not break the snow barrier. Furthermore, this kind of snowplough needs a great deal of energy and is therefore very expensive.

An object of the present invention is to eliminate the above disadvantages, providing a snowplough which attacks the snow barrier, scoring the same from bottom to top, i.e. starting from the base, carrying the scored snow and/or the snow which may have fallen from the top of the barrier, as a consequence of the scoring, rearwardly and distributing the snow on two carrying belts, which "throw" the snow "out" to the left and to the right side of the street, beyond the width of the largest vehicles.

This task is solved, according to the present invention, by placing on a frame, fixed to a tracked mover, already well known, an assembly comprising a main digging and carrying belt, consisting of stretched chains of triangular form, the apexes of which move about support rolls, the rolls being placed at the front and rear ends of and above the tracked mover. On the chains are fixed, by brazing, in a strong perpendicular direction with respect to the longitudinal direction of the chains, at predetermined distances, metallic shovels, with a digging and scoring function, the shovels engaging at the same time dynamically into the links of the tracked mover and thus receiving the operating energy, which will be transmitted to the tracked mover, the greatest part of which is needed for operating said mover, due to the weight of the snow dug by the shovels, and led towards the back of the snowplough, where two secondary carrying belts "throw out" the snow towards the right and the left side of the street, beyond the width of the largest vehicles.

The main idea of the present invention is based on the fact that the snow, when it falls, during the working of the snowplough, on the main carrying belt, serves, due to its weight, to supply most of the energy required for the displacing of the snow, as well as for the movement of the tracked mover, so that the higher the snow barrier and the heavier it is, the higher the saving.

According to the present invention, on a frame, carried by the tracked mover, already well known, is fixed another frame which supports, rearwardly, frontally and on top, three metallic rolls placed in the form of a triangle. On these rolls, at their ends as well as in the space between the ends, are mounted metallic tires, having, along their whole periphery, teeth which are to engage with chains. On these chains, the links of which will be described more in detail, are applied, by brazing and at a predetermined spacing, shovels which have the function of digging and which are strictly perpendicular to the chains. The number of the tires will evidently be twice the number of the chains which are necessary to support the digging shovels.

The position of the front roll must be slightly below the upper run of the track mover to provide a good tension and a good engagement between the links of the tracked mover and the digging shovels, and therefore a good dynamic assembly. Furthermore, the front roll must be slightly projecting frontwardly of the tracked mover to open a first gap in the snow, but not so much that the position of the centre of gravity of the snowplough-tracked means assembly is altered due to an excessive weight of the snow, at least before the main carrying belt has completed a first complete turn.

The rear roll slightly projects rearwardly with respect to the wheel of the tracked mover to guarantee the best engagement between the shovels and the tracked means.

The top roll is placed so as to come as near as possible to the vertical with respect to the front roll, so as to supply as much snow as possible on the area between the front and the rear roll; in any case its inclination should not be excessive, i.e. not as to prejudice its hold on the snow barrier.

On the chains, stretched along the three rolls, are fixed, by brazing, as already said, digging shovels. These shovels—which at their front part are knurled to take a better hold on the snow—have the double function of digging the snow and of engaging with the tracked means from which they receive and/or to which they transmit operating energy. To the shovels are fixed, at a right angle with them and along their whole length, different shovels, which have the function of preventing the snow from falling into the area formed by the three sides of the main carrying belt. The unit of the elements thus forms a real digging and carrying belt. Furthermore, the shovels must always be longer, for example of 50 cm, than the width of the largest vehicle.

In the rear part of the snowplough—tracked mover assembly, below the axial plane of the rear roll, two secondary carrying belts are provided, nearly equal in length to the main carrying belt, with the only difference that they are mounted on ball bearings instead of rolls. These secondary carrying belts must be inclined from the centre towards the left or the right side, with an angle so as to facilitate at a maximum the falling of the snow supplied to them by the main carrying belt, and to be at around 1 meter from the ground. They also must be slightly inclined at an obtuse angle with respect to the plane of the main carrying belt in descent, so as to prevent the falling of the snow from the rear part of the tracked snowplough. Obviously, the belt must slide on ball bearings to reduce to a minimum the friction during the movement. The length of these belts must be bigger, or at least the same, as the length of the digging shovels.

A main feature of the present invention is shown by the links of the chains of the main carrying belt. The links, as contrasted with the links of the normal bicycle chains (from which they derive) have a shape of an arch in the form of a half-moon. The links have a hollow space in their lower part, to allow the engagement with the teeth of the tires applied on the rolls, and they are full in their upper part for a bigger stoutness as well as to allow the application, by brazing, of the digging shovels. Obviously, the teeth must have, between them, distances which provide to the links, made as above described, a perfect rest at the top of the teeth as well as at the base of the teeth in the space between the one and the other, as well as on the plane of the tire, on both sides of the teeth. These teeth must be not too high and their top must be chamfered as to allow a good rotation of the chain.

The driver's cab of the snowplough-tracked mover assembly according to the present invention can be placed, for example, on a frame fixed up to the centre of the tracked mover. It position will be adjustable in height by means of telescoping rods, to allow the driver's cab to become in any case higher than the snow carried by the main carrying belt.

The advantages of the snowplough-tracked mover assembly according to the present invention consist mainly in a considerable saving of operating energy of the whole assembly and, furthermore, in the fact that it can deal with very high snow barriers, as the higher the snow barrier is, the more snow will be "loaded" by the digging shovels and, consequently, the higher will be the weight of the snow which will contribute to the saving of operating energy to be transmitted to the lower tracked mover. Finally safety is obtained because the snowplough-tracked mover assembly "throws out" the snow beyond the width of the largest vehicles on the left and on the right side of the street.

Figures 2, 3, 4, 5:
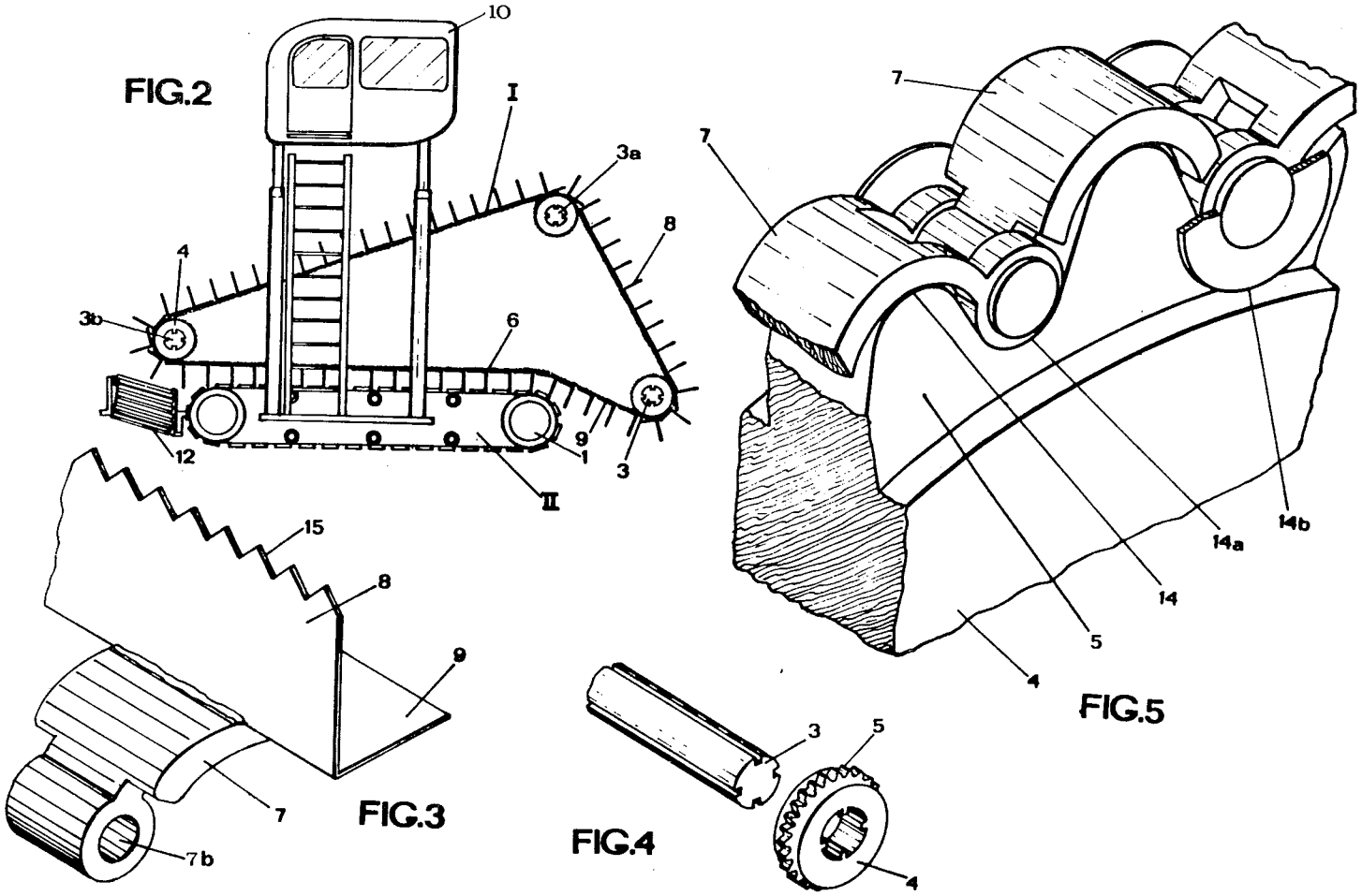

A preferred embodiment of the present invention will be now described, with exemplifying and not limitative purposes, referring to the enclosed drawings, in which the figures show:

FIG. 1, an axonometric view of the snowplough-tracked mover assembly according to the present invention;

FIG. 2, a lateral view of the assembly according to FIG. 1;

FIG. 3, an axonometric view of a brazed shovel provided with teeth on a link of the chain;

FIG. 4, an axonometric view of the roll with a tire, provided with teeth;

FIG. 5, an axonometric view of the links of the chain, in an enlarged scale, engaged on the teeth and resting on the tire.

FIG. 1 shows the upper part I (the real snowplough) and the lower part II (the tracked mover) of the snowplough-tracked mover assembly, the links 2 of the tracked mover, being made of metal and provided with hard rubber. Above the tracked mover, in a way not shown in the drawings, a frame is provided in the form of a triangle, at the apexes of which are placed rolls 3, 3*a* and 3*b*, being respectively the front, top and rear rolls. At the ends of each roll, as well as in the area between their ends, tires 4 provided with teeth 5 are provided, the tires being fixed to the rolls by means of a coupling system. There are at least four tires 4 for each roll, two at the sides and two at the centre. On these rolls 3, 3*a* and 3*b* chains 6 are stretched, the links 7 of which engage on teeth 5 of tires 4. These teeth are not very high and their top is chamfered to allow a good rotation of the chain.

It can be seen in FIG. 1 that front roll 3 somewhat projects with respect to the front wheel 1 of the tracked means and is somewhat closer to the ground than is the upper rim of the tracked mover. This facilitates the opening of a first gap in the snow barrier, as well as engagement between the digging shovels of upper part I (real snowplough) and lower part II (tracked mover) of the assembly. Furthermore, still in FIG. 1, it can be seen that the distance between front roll 3 and upper roll 3*a* is equal to half the distance between upper roll 3*a* and rear roll 3*b*. The more the side 3-3*a* of triangle 3-3*a*-3*b* is going to place itself perpendicularly with respect to the ground, the bigger will be the weight of the snow on side 3*a*-3*b* of the triangle and, consequently, the bigger will be the contribution to the operating energy of the assembly, applied by the snow by its own weight. Obviously, side 3-3*a* must never be perfectly perpendicular to the ground, as that would present a greater scoring difficulty of the snow barrier as well as a displacement of the centre of gravity of the assembly.

On chains 6 of upper part I of the assembly are applied, by brazing, digging shovels 8. Thus a main carrying belt is formed, comprising chains 6 and shovels 8. To prevent the snow from falling into the triangle inside of which the moving carrying belt slides, shovels 9 are fixed at a right angle with respect to shovels 8 along the lower edge of said shovels 8, shovels 9 having the task of closing the free spaces between shovels 8. Shovels 8 have the double function of scoring the snow from the barrier, leading it rearwardly, and of dynamically engaging with links 2 of the chains of the tracked means; thus the shovels receive operating energy from the tracked mover, while, after the first complete turn of the main carrying belt, they supply to themselves and to the tracked means most of the operating energy with a considerable saving of energy for the complete assembly.

Still in FIG. 1 two secondary carrying belts 11 and 12, formed of any soft material, can be seen. Belts 11 and 12 are hinged on a pivot 13 to form together an angle so as to facilitate to a maximum the falling of the snow from the main carrying belt, and they have an inclination with respect to the plane of the main carrying belt. Both belts 11 and 12 slide on ball bearings, which reduce to a minimum the friction. The length of these belts is bigger or at least equal to the length of shovels 8.

FIG. 2 shows the positioning of the driver's cab 10 supported by rods which can be adjusted in height with a telescoping system.

FIG. 3 shows digging shovels applied by brazing on links 7 of chains 6, as well as shovels 9 at a right angle with said shovels 8.

FIG. 4 shows one of the tires 4 provided with teeth 5. These tires are inserted onto rolls 3, 3*a* and 3*b*.

FIG. 5 shows the links 7 of chain 6 of part I (real snowplough), which engage with teeth 5 of tires 4. These links have nearly the shape of a half-moon. Their inner part is hollow to allow engagement with teeth 5, while their upper part is full to allow a greater stoutness to the engagement with top 14 of the tooth for the application of the digging shovels. Their ends *7a* and *7b* rest on base 14*a* of the teeth as well as on the plane 14*b* of the tire very near to the teeth 5.

Obviously, other forms, proportions and dispositions can be adopted without therefore going out of the limits of the invention.

What I claim is:

1. A tracked snowplough to work mainly against very high snow barriers, comprising tracked mover means; a frame fixed to the tracked mover means; a main digging and carrying belt assembly including a plurality of multi-link chains stretched in the form of triangles, a plurality of rotatable support rolls positioned at the apexes of the triangles, the rolls being positioned at the front and rear ends and the top of the tracked mover means, a plurality of digging shovels fixed, by brazing, onto the chains in a substantially perpendicular direction with respect to the chains and at predetermined distances therealong, the shovels engaging the tracked mover means; and two secondary carrying belts at the rear of the tracked mover means to receive snow from the shovels and to throw out the snow towards the right side and the left side of the snowplough.

2. A tracked snowplough according to claim 1, wherein the shovels are frontally knurled.

3. A tracked snowplough according to claim 1, wherein the front roll is positioned closer to the ground than is the upper surface of the tracked mover means.

4. A tracked snowplough according to claim 1, wherein the front roll projects frontally with respect to the front of the tracked mover means.

5. A tracked snowplough according to claim 1, wherein the upper roll is substantially vertically above the front roll.

6. A tracked snowplough according to claim 1, further comprising a plurality of second shovels positioned between the digging shovels to prevent the falling of snow into the triangular space within the chains.

7. A tracked snowplough according to claim 1, further comprising ball bearing means supporting the two secondary carrying belts.

8. A tracked snowplough according to claim 1, wherein the links of the chains have the form of an arch in the shape of a half-moon.

9. A tracked snowplough according to claim 8, wherein the links of the chains have a hollow space in their lower part and are full in their upper part.

10. A tracked snowplough according to claim 1, further comprising a plurality of toothed tires on the support rolls, the teeth of the tires having a space between them and being chamfered at the top to allow the chain links a perfect rest at the top of the teeth as well as at the plane of the tire on both sides of the teeth.

* * * * *